US008177157B2

(12) United States Patent
Weissbrod

(10) Patent No.: US 8,177,157 B2
(45) Date of Patent: May 15, 2012

(54) CASTELLATED REEL CORE

(75) Inventor: Paul A. Weissbrod, South Euclid, OH (US)

(73) Assignee: Lincoln Global, Inc., City of Industry, CA (US)

( * ) Notice: Subject to any disclaimer, the term of this patent is extended or adjusted under 35 U.S.C. 154(b) by 565 days.

(21) Appl. No.: 12/251,783

(22) Filed: Oct. 15, 2008

(65) Prior Publication Data

US 2010/0090049 A1 Apr. 15, 2010

(51) Int. Cl.
*B65H 75/22* (2006.01)
*B65H 75/14* (2006.01)

(52) U.S. Cl. ..... 242/608.4; 242/118.6

(58) Field of Classification Search ..... 242/608.4, 242/608.3, 608.7, 608, 608.2, 608.8, 607, 242/118.6, 118.61, 118.62, 609, 609.1, 609.2, 242/609.4, 407.1, 608.6
See application file for complete search history.

(56) References Cited

U.S. PATENT DOCUMENTS

| | | | | |
|---|---|---|---|---|
| 2,115,481 A | | 4/1938 | Clemmons | |
| 2,689,097 A | | 9/1954 | Carris | |
| 3,679,228 A | * | 7/1972 | Settimi | 297/476 |
| 3,942,741 A | | 3/1976 | Hussar et al. | |
| 5,139,209 A | * | 8/1992 | Kramer | 242/118.7 |
| 5,931,409 A | * | 8/1999 | Nulle et al. | 242/605 |
| 5,954,294 A | * | 9/1999 | Forsner | 242/604 |
| 6,715,710 B1 | | 4/2004 | Russell et al. | |
| 7,222,818 B2 | | 5/2007 | Couchey et al. | |

FOREIGN PATENT DOCUMENTS

| | | |
|---|---|---|
| DE | 75 22 539 | 7/1975 |
| GB | 1249886 | 10/1971 |
| WO | 9509800 | 4/1995 |
| WO | 2005047156 | 5/2005 |

OTHER PUBLICATIONS

International Preliminary Report on Patentability for application PCT/IB2009/007075 dated Dec. 1, 2010.

* cited by examiner

*Primary Examiner* — William E Dondero
(74) *Attorney, Agent, or Firm* — Hahn Loeser & Parks LLP

(57) ABSTRACT

A spool or reel for retaining continuously wound material may include a central barrel and spaced apart flange members extending from the central barrel. The central barrel has an outer face for receiving the continuously wound wire, wherein both ends of the barrel are castellated. The inner face of a first and second flange include an interrupted groove comprised of a series of slots that are sized to receive the castellated first end of the barrel and the flanges are secured to the barrel by a plurality of through-bolts extending from the first flange to the second flange, securing the first flange to the first end of the barrel and the second flange to the second end of the barrel. The castellated ends of the barrel and the portions of the interrupted groove between the slots form a criss-crossed pattern that prevents the wire from entering the slots or entering the barrel and tangling during payoff of the wire, even when the spool is heated.

14 Claims, 6 Drawing Sheets

CASTELLATED REEL CORE

TECHNICAL FIELD

The present invention pertains to spools for storing and dispensing wire and more particularly, to spools used to retain welding wire.

BACKGROUND OF THE INVENTION

Spools or reels are well known for transporting and storing bulk wire, cable and/or other wound material such as welding wire, electrical wire, bailing wire, and the like. A typical spool comprises a pair of disc-shaped flanges joined by a central barrel. Wire or cable is spirally wound around the central barrel between the spaced flanges until the spool is filled with the appropriate amount of material. Filled spools can then be stacked atop one another for shipment, storage and subsequent use. When it is desired to dispense the wire or cable, it may be pulled progressively from the spool, which may, for example, be mounted on an arbor or spindle to rotate and thus pay out the wound material. Other pay out methods include laying the spool flat on a flange and using a flyer payoff unit mounted that spins the wire off over the upper flange to pay out the wound material.

Spools used for holding welding wire are typically constructed of a generally cylindrical core or barrel, which can be made from a variety of materials and can come in a variety of different diameters and lengths. Attached at either end of the core are two flanges which are generally round and serve to retain the welding wire on the barrel. The flanges are generally constructed using a lathe which cuts them to shape and cuts a continuous groove on the inner face of both flanges to receive the barrel. The spool is held together by a series of through-bolts that run through drilled holes in one flange, through the barrel, and through drilled holes in the other flange.

The end of a continuous supply of welding wire from a welding wire manufacturing line or other source is then secured to the spool and the spool is rotated to wind the welding wire onto the spool. Once wound on the spool, the welding wire exerts a powerful spreading force against the flanges. This tends to cause the through-bolts to loosen, and can create gaps between barrel and one or both of the flanges and may permit the flanges to rotate relative to the barrel during winding and payoff of the wire. Further, gaps between the barrel and the flange are also created or made worse by differential shrinkage of the barrel and the flanges when the spool is heated, either by receiving the wire, which is often hot or by heat drying the spool before use. These gaps create problems when, as is often the case, the welding wire is of a relatively small diameter and can spread into the groove in the flange causing it to tangle during payoff of the wire from the spool to the welder. These tangles in the welding wire during use cause interruptions in the welding process and often require the user to scrap several pounds of otherwise good welding wire.

BRIEF SUMMARY

In one embodiment of the subject invention the spool for retaining wire has a barrel with an outer face for receiving the associated wire wherein at least one of the first end of the barrel or the second end of the barrel have a plurality of tabs extending therefrom. The spool also has a first and/or a second flange having a plurality of slots, sized to receive the tabs extending from the first and second ends of the barrel and one or more bolts operatively connected to secure the first flange to the first end of the barrel and the second flange to the second end of the barrel. The tabs and the portion of the inner faces of the flanges between the slots form a crisscrossed pattern that prevents the wire from entering the slots or entering the barrel and tangling during payoff of the wire, even when the spool is heated.

DETAILED DESCRIPTION OF THE INVENTION

Figure 1:
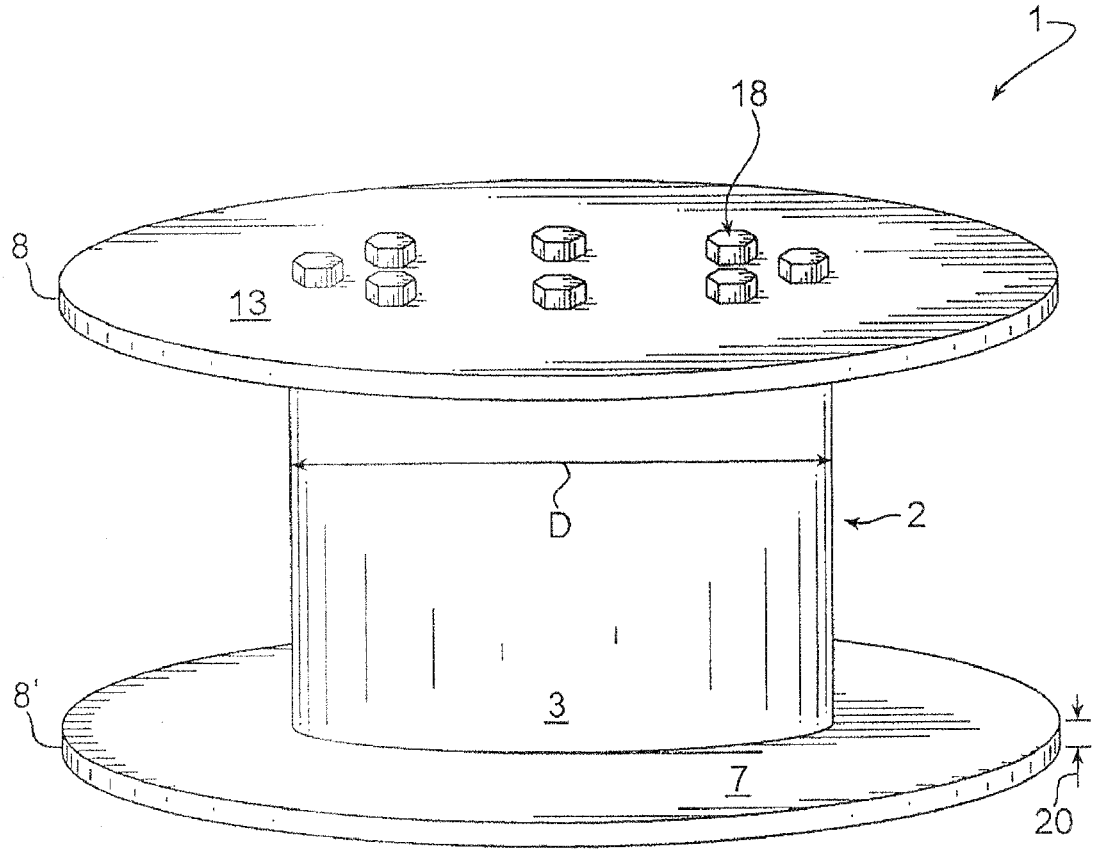
FIG. 1 is a perspective view of a spool according to the embodiments of the present invention.

Referring now to the drawings wherein the showings are for purposes of illustrating embodiments of the invention only and not for purposes of limiting the same. FIG. 1 shows a spool or reel depicted generally at 1. The spool 1 may be used to retain contiguously formed material, such as for example wire, cable, line, rope, or string of various types. In one embodiment, the contiguously formed material may be welding wire. In one embodiment, the spool 1 may be constructed from an assembly of components, namely first 8 and second 8' flanges and a barrel 2. Each individual component may be separately fashioned and affixed together in a subsequent process. Fasteners may be used to hold the assembly together, which may include threaded bolts, as will be discussed further below.

Figure 2:
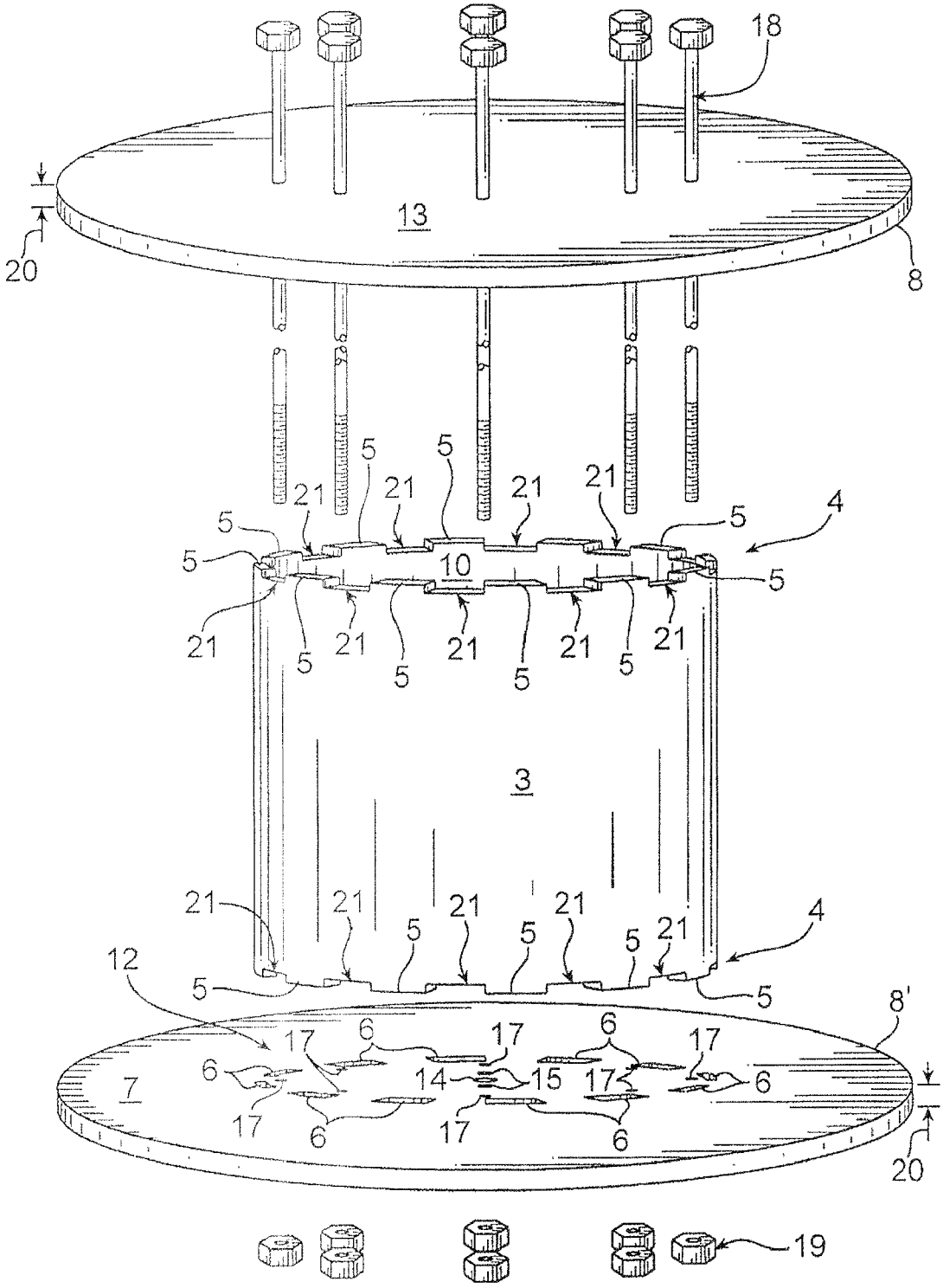
FIG. 2 is an exploded perspective view a spool according to the embodiments of the present invention.

With continued reference to FIG. 1 and now to FIG. 2, the spool 1 may include a core or barrel 2, which may be generally cylindrical in configuration. However, other configurations of the barrel 2 may be chosen without limiting the intended scope of coverage of the embodiments of the subject invention. The barrel 2 may include an outer surface 3 characterized by an outer diameter D, on which the material or wire may be wound and dispensed as discussed above. The outer diameter D of the barrel may vary with the type and length of material held by the spool, but should be less than diameter of the flanges discussed below. More specifically, the outer diameter D may be in the range of 12 to 20 inches. The barrel further has a barrel length L, extending between two flanges. The barrel length L may vary with the type and length of material held by the spool, but may be in the range of 9 to 17 inches. Still, persons of ordinary skill in the art will understand the application of the embodiments of the subject invention to any size spool 1, outside barrel diameter D or barrel length L.

The barrel may be constructed of any material of sufficient strength to support the compressive force of the wire or other material held on the spool. In an exemplary manner, the barrel is made of a fiber laminate, such as such as kraft paper, particle board, flake board, oriented strand board, plywood, solid wood staves, molded plastic, or other suitable materials.

Figure 3:
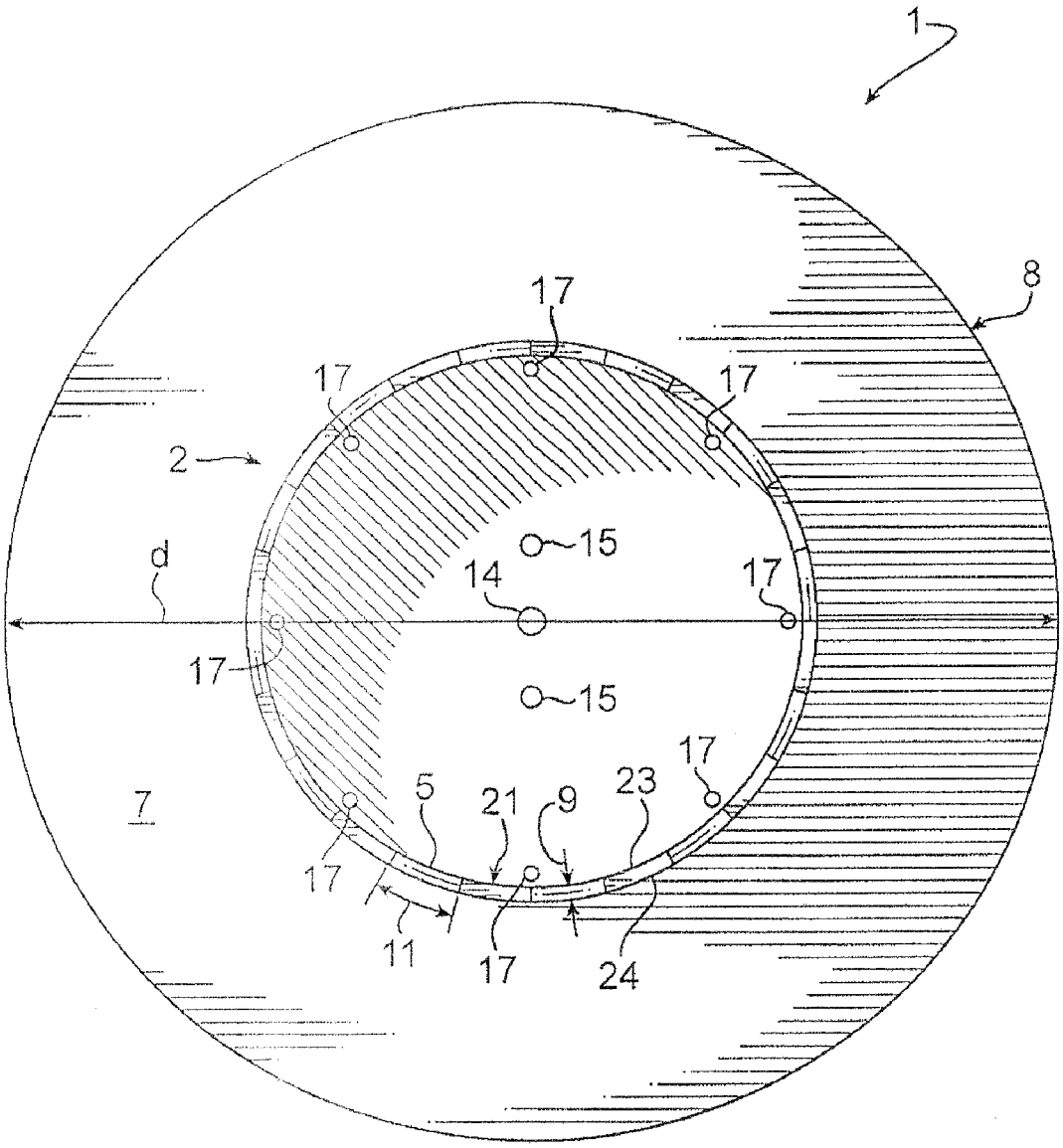
FIG. 3 is a cutaway end view of the barrel and one flange of a spool according to the embodiments of the present invention.
Figure 4:
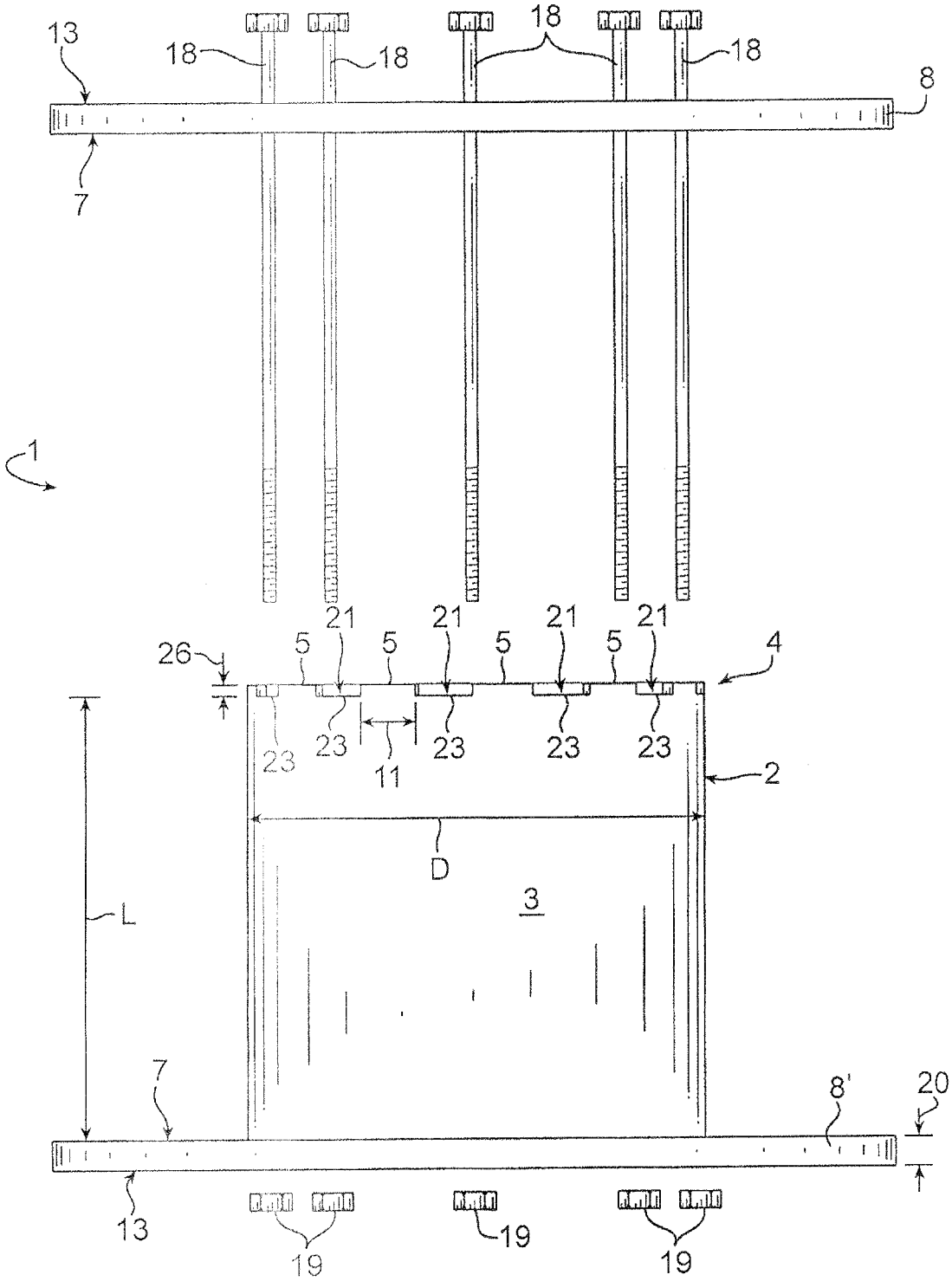
FIG. 4 is an exploded side view a spool according to the embodiments of the present invention.
Figure 6:
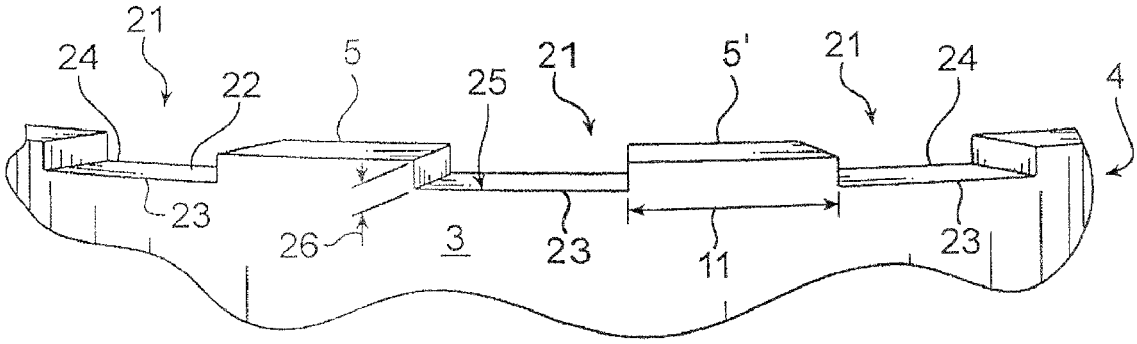
FIG. 6 is cutaway side view of the end of the barrel of a spool according to the embodiments of the present invention.

With continued reference to FIG. 2, and now to FIGS. 3, 4, and 6, the ends of the barrel 4 may have tabs 5 sized to fit into corresponding slots 6 in the inner face 7 of the first and second flanges 8. The tabs 5 may be substantially square or rectangular in shape but other embodiments are contemplated where the tabs 5 may be any other suitable shape. The tabs 5 may be formed on distal ends 4 of the barrel 2 by removal of the barrel material between the tabs 5 to form a substantially concave indentation or notch 21 bounded on a first side by one tab 5,' on a second side by an adjacent tab 5", and by an indentation bottom 22 extending between the tabs 5', 5." A thickness is defined by an outer boundary 23 contiguous with the outer barrel surface and an inner boundary 24 contiguous with the inner barrel surface 10. To avoid unnecessary gaps, the outer boundary 23 may form a substantially straight line and be oriented perpendicular to the barrel length L. When the spool 1 is assembled, the outer boundary 23 of the indentation bottom 22 abuts the inner flange face 7 so that there is no gap between the barrel 2 and the first and second flanges 8 for the welding wire or other material to become trapped. Accordingly, the angle formed by the outer barrel face 3 and the bottom surface 25 of the indentation bottom 22 is substantially 90 degrees or less to prevent a gap being formed between the outer boundary 23 and the inner flange face 7 and to ensure that the flange may be properly seated onto the barrel. Moreover, the outer boundary 23 of the indentation bottoms 22 on a particular barrel end 4 would, if extended for a continuous line around the circumference of the barrel be perpendicular to the barrel length L.

The indentation 21 may be formed using any method suitable to the material from which the barrel is constructed. Methods for removing material to form the tabs 5 may include, but are not limited to, stamping, routing, cutting, milling, and the like. In one embodiment of the spool 1, the tabs 5 are formed in a barrel 2 using a stamping process to remove fiber laminate material from between the tabs. In this embodiment, the die used to stamp the material from the barrel 2 has a slightly dovetailed profile so that the material stamped from the barrel may be retained within the die.

With continued reference to FIGS. 2-4 and 6, the tabs 5 may have a tab thickness 9 defined by the outer surface 3 of the barrel 2 and the inner surface 10 of the barrel 2. The tab 5 may also have a tab width 11. In addition, each tab 5 has a tab length 26, which is less than or equal to the slot depth 27. In one embodiment, the tabs 5 may be spaced uniformly around the circumference of each barrel end 4, although other embodiments are contemplated where the spacing between tabs 5 varies. The number, width, and spacing of the tabs 5 may depend upon the size of the spool 1 and the diameter of the wire or other material held by the spool but should be sufficient that if the flanges are forced apart from the barrel as described above, the wire or other material cannot be forced into the slots 6 in the interrupted groove 12 in the inner face 7 of the flanges 8.

In one embodiment, the ends of the barrel 4 may be castellated to form a series of equally spaced tabs on the ends of the barrel 4 sized to be received by slots 6 of the interrupted groove 12 cut in the inner face 7 of the first and second flanges 8. In this embodiment, barrel ends 4 are castellated which means that the indentations 21 are substantially square or rectangular in shape and spaced at regular intervals around the barrel ends 4 to create substantially rectangular tabs 5 of substantially the same size regularly spaced along the barrel ends 4. While the tabs 5 may be substantially square or rectangular in shape, those of ordinary skill in the art will understand that indentations 21 may be cut using a die with a slightly dovetailed profile of about 3 degrees to 5 degrees in order to retain the material removed within the die.

Figure 5:
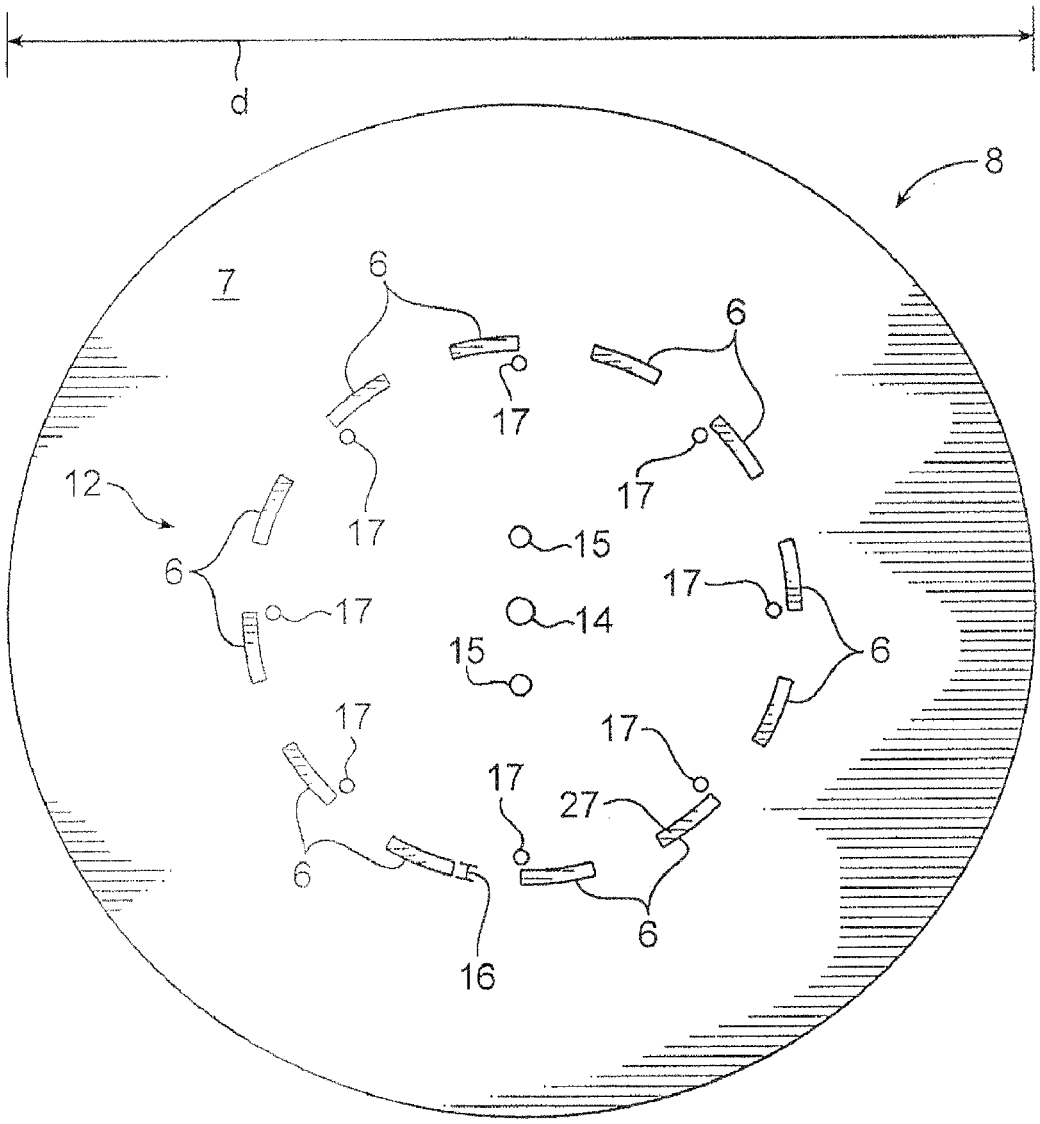
FIG. 5 is an end view of a flange of a spool according to the embodiments of the present invention.

With continued reference to FIGS. 2-4 and now FIG. 5, the spool 1 includes first and second flanges 8 that comprise side walls for retaining the wire or other continuous material on the spool 1. The first and second flanges 8 may extend substantially perpendicular with respect to the outer surface 3 of the barrel 2. The first and second flanges 8 may also be laterally positioned at distal ends of the barrel 2. In this manner, the cross-section or contour of the first and second flanges 8 and the barrel 2 may form a U-shaped channel. Accordingly, each of the first and second flanges 8 may include an inner flange face 7 for contacting the wire or other material and an outer flange face 13. As such, the cross section of the inner flange faces 7 and outer surface 3 of the barrel 2 may be convex with respect to an axis of rotation of the spool 1. The first and second flanges 8 have an outside diameter d, which may be varied depending upon the type and length of the material held by the spool 1 and requirements of any device into which the spool 1 may be loaded. More specifically, the outer diameter d of the first and second flanges 8 may be approximately 30 inches. However, it is to be construed that any outside diameter d of the first and second flanges 8 may be chosen as is appropriate for use with the embodiments of the subject invention.

The first and second flanges 8 may be constructed from any suitable material with sufficient rigidity to resist deformation by the spreading forces applied to the flanges 8 by the wire or other material wound on the spool. Suitable materials may include plywood, kraft paper, particle board, flake board, oriented strand board, plywood, solid wood staves or molded plastic. With continued reference to FIGS. 2 and 4, flange thickness 20 of the first and second may be varied depending upon the type of material used to make the flanges 8, as well as the type and length of the material held by the spool, but may be plywood having a thickness of approximately 1 inch. The flanges 8 may be constructed using any known method for shaping the material used into the flange 8 and for creating the interrupted groove 12. In one embodiment, the flanges 8 are constructed from 1 inch thick plywood using a router.

With continued reference to FIG. 5, the first and second flanges 8 may have a center hole 14, which may receive a spindle comprising the axis of rotation for the flange 8. The first and second flanges 8 may also have one or more drive holes 15 for use with drive or braking systems. In one embodiment of the spool 1, there are two drive holes 15 each spaced about 2.5 inches from the center hole 14 and oriented 180 degrees from each other with respect to the center hole 14. However, it is to be construed that any number or orientation of drive holes 15 may be chosen as is appropriate for use with the embodiments of the subject invention.

Unlike the flanges in the prior art which have a continuous groove for receiving the ends of the barrel, the spool 1 of the present invention has an interrupted groove 12 formed by a series of slots 6 oriented to receive the tabs 5. The interrupted groove 12 has a groove width 16 approximately equal to the tab thickness 9 and may be substantially uniform about its circumference. Each slot 6 forming the interrupted groove 12 is at least as long as the corresponding tab width 11. In one embodiment of the spool 1, however, the slots 6 are slightly larger than the tabs 5 to allow for shrinkage in the flanges 8 and barrel 2 without breaking and without creating a large enough opening between the either flange 8 and the barrel 2 to permit the wire or other wound material to enter. Each of the slots 6 forming the interrupted groove 12 may have a slot depth 27 greater than or equal to the tab length 26 and less than or equal to the flange thickness 20. In this manner, the tabs 5 do not extend axially outside of the flanges 8. In one embodiment of the spool 1, slots 6 forming the interrupted groove 12 are made using a router, but the interrupted groove 12 may be created using any other method known to those of ordinary skill in the art.

Each flange 8 may also have a plurality radially spaced through-bolt holes 17 proximate to the interrupted groove 12 and between the center hole 14 and the interrupted groove 12. In one embodiment of the spool 1, the through-bolt holes 17 may be located close to the interrupted groove. More specifically, the through-bolt holes 17 may be located approximately 0.12 inches from the interrupted groove 12. It is noted here that the through-bolt holes 17 disposed at regular intervals. However any interval of spacing may be incorporated as is appropriate for use with the embodiments of the present invention. In addition, the through-bolt holes 17 in the first flange 8 must be in the same location as the through-bolt holes 17 in the second flange 8 so that when the spool 1 is assembled, the through-bolts holes 17 line up to permit through-bolts 18 to travel through both flanges 8 to secure the flanges 8 to the barrel 2.

With continued reference to FIGS. 1-4, the spool 1 may be assembled by inserting the tabs 5 of the first barrel end 4 into the slots 6 of the first flange 8 and by inserting the tabs 5 on the second barrel end 4 into the slots 6 in the second flange 8. The flanges 8 may be secured to the barrel 2 by any conventional means including, but not limited to, adhesives, staples, nails, screws, or bolts. In one embodiment, the first and second flanges 8 are secured to the barrel 2 using through-bolts 18 and nuts 19 operatively connected between the first and second flanges 8. In another embodiment, only one flange 8 is attached to the barrel 2 and it is secured by any conventional means including, but not limited to, adhesives, staples, nails, screws, or bolts.

The invention has been described herein with reference to the preferred embodiment. Obviously, modifications and alterations will occur to others upon a reading and understanding of this specification. It is intended to include all such modifications and alternations in so far as they come within the scope of the appended claims or the equivalence thereof.

The invention claimed is:

1. A spool for retaining wire, comprising:

a contiguously cylindrical barrel having an inner surface defining an inner diameter, an outer face for receiving associated wire, a pair of opposed ends, wherein both ends of the barrel have a plurality of laterally-extending tabs extending therefrom, each of the plurality of tabs having a width, a flange penetration length perpendicular to the width, and a thickness;

a pair of opposed flanges having a uniform diameter and an inner face and an outer face, wherein the inner faces of each of the flanges includes an interrupted annular groove comprising a plurality of slots, sized to receive the laterally-extending tabs from the ends of the barrel, the interrupted annular groove comprising a plurality of slots separated by spaces therebetween, each slot having a depth, said flange penetration length being less than or equal to said slot depth, said plurality of tabs and slots determined by a size of said spool and a diameter of said wire and spaced so that if said flanges are forced apart from said barrel, said wire cannot be forced into said slots in said interrupted annular groove; and one or more bolts operatively connected to secure each flange to the opposed ends of the barrel.

2. The spool as defined in claim 1, wherein the one or more bolts include a plurality of through-bolts extending between said flanges.

3. The spool as defined in claim 1, wherein the barrel is made of a fiber laminate.

4. The spool as defined in claim 1, wherein the distance between each of the plurality of tabs is approximately equal to the width of each of the plurality of tabs.

5. The spool as defined in claim 1, wherein the plurality of tabs are generally rectangular in shape.

6. A spool for retaining wire, comprising:

a continuously cylindrical barrel having an outer face for receiving associated wire, a pair of opposed ends, wherein both ends of the barrel are castellated, an inner surface of the barrel defining an inner diameter;

a pair of opposed flanges having a uniform diameter and an inner face and an outer face, wherein the inner faces of each of the flanges includes an interrupted annular groove comprising a plurality of slots, each slot sized to receive the castellated ends of the barrel, the interrupted annular groove comprising said plurality of slots separated by spaces therebetween, each slot having a depth, a castellated end penetration length being less than or equal to said slot depth, said plurality of castellated ends and slots determined by a size of said spool and a diameter of said wire and spaced so that if said flanges are forced apart from said barrel, said wire cannot be forced into said slots in said interrupted annular groove; and a plurality of through-bolts extending between said flanges, securing the flanges to the barrel.

7. The spool as defined in claim 6, wherein the wire is welding wire.

8. The spool as defined in claim 6, wherein the barrel is made of a fiber laminate.

9. The spool as defined in claim 6, wherein said first and second flanges are adhesively secured to said barrel.

10. A retaining device for holding a continuous material, comprising:

a contiguously cylindrical barrel for receiving the continuous material having a pair of ends, wherein both ends of the barrel have a plurality of irregularly spaced laterally-extending tabs extending therefrom, each of the plurality of tabs having a width, a tab penetration length perpendicular to the width, and a thickness;

a pair of opposed flanges extending from opposed ends of the barrel, the flanges having an outer flange face and inner flange face wherein the inner flange face of the flanges includes an interrupted annular groove comprising a plurality of slots sized to receive the laterally-extending tabs extending from the ends of the barrel, the interrupted annular groove comprising a plurality of slots separated by spaces therebetween, each slot having a depth, said flange penetration length being less than or equal to said slot depth, said plurality of tabs and slots determined by a size of said spool and a diameter of said wire and spaced so that if said flanges are forced apart from said barrel, said wire cannot be forced into said slots in said interrupted annular groove; and a securing means, for securing the flanges to the barrel.

11. The retaining device of claim 10, wherein the securing means is a plurality of through-bolts extending between said flanges.

12. The retaining device as defined in claim 10, wherein the securing means is an adhesive.

13. The retaining device as defined in claim 10, wherein the continuous material is welding wire.

14. The retaining device as defined in claim 10, wherein the barrel is made of a fiber laminate.

* * * * *